US007939137B2

(12) United States Patent
Becker-Weimann et al.

(10) Patent No.: US 7,939,137 B2
(45) Date of Patent: May 10, 2011

(54) METHOD AND DEVICE FOR PRODUCING PARTS HAVING A SEALING LAYER ON THE SURFACE, AND CORRESPONDING PARTS

(75) Inventors: Klaus Becker-Weimann, Karlsruhe (DE); Oliver Büker, Marxzell-Burbach (DE); Uwe Schroeder, Marxzell-Schielberg (DE)

(73) Assignee: Klebchemie M.G. Becker GmbH & Co. KG, Weingarten/Baden (DE)

( * ) Notice: Subject to any disclaimer, the term of this patent is extended or adjusted under 35 U.S.C. 154(b) by 780 days.

(21) Appl. No.: 10/478,143

(22) PCT Filed: May 16, 2002

(86) PCT No.: PCT/DE02/01771

§ 371 (c)(1),
(2), (4) Date: May 10, 2005

(87) PCT Pub. No.: WO02/094457

PCT Pub. Date: Nov. 28, 2002

(65) Prior Publication Data

US 2005/0255250 A1 Nov. 17, 2005

(30) Foreign Application Priority Data

May 18, 2001 (DE) ..... 101 24 676

(51) Int. Cl.
*B05D 3/02* (2006.01)

(52) U.S. Cl. ..... 427/377; 427/385.5; 427/397

(58) Field of Classification Search ..... 428/423.1; 427/377, 398.1, 384, 394, 397, 385.5
See application file for complete search history.

(56) References Cited

U.S. PATENT DOCUMENTS

| | | | | |
|---|---|---|---|---|
| 3,139,372 | A | 6/1964 | Elliott | |
| 3,537,946 | A * | 11/1970 | Montagnino et al. | 428/97 |
| 3,900,690 | A | 8/1975 | Schwarz | |
| 3,963,820 | A | 6/1976 | Blakey | |
| 4,169,005 | A | 9/1979 | Fogle et al. | |
| 4,204,051 | A * | 5/1980 | Wellner et al. | 528/55 |
| 4,418,106 | A | 11/1983 | Landler et al. | |
| 4,865,912 | A | 9/1989 | Mitsumata | |
| 5,350,617 | A | 9/1994 | Fujisawa et al. | |
| 5,418,034 | A | 5/1995 | McGuire, III | |
| 6,004,648 | A | 12/1999 | Snyder | |
| 6,180,172 | B1 | 1/2001 | Hasenkamp et al. | |
| 6,180,175 | B1 | 1/2001 | Saika et al. | |
| 6,258,918 | B1 * | 7/2001 | Ho et al. | 528/66 |
| 6,271,305 | B1 * | 8/2001 | Rajalingam et al. | 524/705 |
| 6,280,561 | B1 * | 8/2001 | McInnis et al. | 156/305 |
| 6,432,237 | B1 | 8/2002 | Hasenkamp et al. | |
| 2002/0056938 | A1 | 5/2002 | Hasenkamp et al. | |

FOREIGN PATENT DOCUMENTS

| | | |
|---|---|---|
| CA | 2 187 055 | 4/1997 |
| DE | 1170606 | 5/1961 |
| DE | 4137135 | 5/1993 |
| DE | 195 43 901 | 5/1996 |
| DE | 198 06 136 | 8/1998 |
| EP | 0197324 | 3/1986 |
| EP | 0612609 | 8/1994 |
| EP | 0 699 545 | 3/1996 |
| EP | 0699545 | 3/1996 |
| EP | 0744260 | 11/1996 |
| EP | 0 838 269 | 4/1998 |
| EP | 0838269 | 4/1998 |
| EP | 0 918 600 | 6/1999 |
| GB | 2213406 A * | 8/1989 |
| WO | WO95/01869 | 1/1995 |
| WO | WO98/04390 | 2/1998 |
| WO | WO 02/094457 | 11/2002 |

OTHER PUBLICATIONS

K. Weigel, :"Polyurethan Lacke", 1966, pp. 28 and 29.
Decision of the European Patent Office in the Opposition Proceedings Between Klebchemie M.G. Becker GmbH & Co. KG and Henkel KGaA.
Office Action dated Mar. 7, 2008, in related U.S. Appl. No. 10/478,145, filed Jul. 2, 2004.
Office Action dated Jul. 10, 2008, in related U.S. Appl. No. 10/478,145, filed Jul. 2, 2004.
Office Action dated Sep. 3, 2008, in related U.S. Appl. No. 10/478,145, filed Jul. 2, 2004.
Office Action dated Mar. 20, 2009, in related U.S. Appl. No. 10/478,145, filed Jul. 2, 2004.
Office Action dated Aug. 18, 2009, in related U.S. Appl. No. 10/478,145, filed Jul. 2, 2004.
Office Action mailed Mar. 19, 2010, in co-pending U.S. Appl. No. 10/478,145.
Amendment filed Jul. 13, 2010, in in co-pending U.S. Appl. No. 10/478,145.

* cited by examiner

*Primary Examiner* — Thao T. Tran
(74) *Attorney, Agent, or Firm* — Baker & Daniels LLP

(57) ABSTRACT

The invention relates to a method and a device for producing parts (1) having a sealing layer (2) on the surface, and corresponding parts. Said method and device are improved in that the sealing layer (2) is applied to the surface in the form of a water-free and solvent-free reactive hot melt layer based on polyurethane and hardened by atmospheric humidity, and the inventive device comprises an application station (6), a transport device (5) and a smoothing station (8).

18 Claims, 2 Drawing Sheets

METHOD AND DEVICE FOR PRODUCING PARTS HAVING A SEALING LAYER ON THE SURFACE, AND CORRESPONDING PARTS

The invention relates to a method for producing parts having a sealing layer on the surface and corresponding parts.

Lacquers are currently being used as sealing layers on the surface of a large number of parts in various areas of application, for example, in the furniture and wood-processing industry, but also for parts made of steel, nonferrous metals, plastic, paper, cardboard, papier-mâché, or mineral substances. UV-hardening lacquers, usually applied to the parts by means of a roller, less often by spraying, are a widespread system for lacquering. The subsequent curing process takes place using UV light or UV lamps. The mechanical effort during lacquering with UV lacquers is very high and requires a lot of space. The reason for the large spatial requirement is also that lacquering processes with UV-hardening systems usually require more coats: three to four coats are normally required. Due to the viscosity and especially the full UV hardening, each coat of lacquer can only be applied in ca. 10 to 20 my layers, which is also why several coats of lacquer are necessary. UV lamps and the necessary energy for the curing are very expensive.

Other lacquer systems, e.g. 2-K-PUR lacquers, nitrocellulose lacquers, or water lacquers must also be applied in several layers. Fillers, primers, and, if necessary, intermediate coats are also always required and make the surface coating a process that is complex and mechanically very costly and expensive.

It is known from DE 198 06 136 C2 that a board for a parquet floor is provided with a least one layer of wood and one sealing layer on its surface should be formed so that the sealing layer is made of a water-free and solvent-free reactive hot melt layer based on polyurethane and hardened by atmospheric humidity. The reactive hot melt layer is thereby blade-coated, rolled, or sprayed onto the layer of wood. This coat can lead to undesired unevenness in the sealing layer. Moreover, the reactive hot melt layer can still be sticky after it has been applied so that the sealing layer can be damaged when handling the parquet-board semi-finished products or the individual parts can stick to each other when stacked. In practice, the cooling zone suggested in DE 198 06 136 C2 is associated with high costs for the preparation of the very cold, humid air.

The purpose of this invention is to advantageously advance the state of the art.

This purpose is fulfilled with the characteristics of the independent claims.

First, it is recognized that a water-free and solvent-free reactive hot melt layer based on polyurethane and hardened by atmospheric humidity can also be used for the formation of a sealing layer on various other types of materials in order to advantageously replace the previous lacquers. This is also the case with furniture parts that are made of solid wood or veneered parts with a wood or derived-timber product base material and adhered veneer. In addition to this, such a reactive hot melt layer can also be used for the sealing of wood-like materials, parts made of steel, nonferrous metals, plastic, paper, cardboard, or mineral substances. With all of these different types of materials, a single coat without intermediate treatment in the form of polishing, precipitation, or similar can be formed with a sealing layer with coat strengths between 5 and 150 my that has a very high resistance to attrition, high tenacity and scratch resistance, good shock resistance and residual elasticity for avoiding brittle breaks, high chemical resistance, and, depending on the requirements and demands, good UV resistance. In addition, this type of surface finishing is mechanically easy and thus more economical.

In addition to this, for all parts with a sealing layer on their surface that is a water-free and solvent-free reactive hot melt layer based on polyurethane and hardened by atmospheric humidity, an improvement can be made in surface properties in that, after being applied to the surface of the part, the reactive hot melt layer is smoothed. Unevennesses in the surface that can result from the mere coating of the hot reactive melt layer are thereby avoided and an even smoother surface is created. Then, it is also possible to work with less amounts of material, between 70 and 100 g/m$^2$ of the reactive hot melt.

The water-free and solvent-free reactive hot melt layer is applied to the surface to be sealed at a temperature above 100° C., approx. 100° C. to 140° C. In this process, approx. 70 to 100 g of the reactive hot melt is applied per square meter of surface to be sealed. The reactive hot melt usually has a thickness of ca. 1.1 g/m$^2$ and a viscosity, according to Brookfield, at 120° C. of ca. 4,000 mPas and at 140° C. of ca. 2,400 mPas. It is a good idea to apply the reactive hot melt layer while the part is hermetically sealed and protected from humidity in order to prevent a premature response. For example, the layer can be blade-coated, rolled on, sprayed on or applied by means of a nozzle or fan nozzle. Even in a hardened state as a 100% solid body, the reactive hot melt layer still has a certain residual elasticity.

Before any potential further processing of the surface-coated parts, the parts should be able to cross-link for 3 to 5 days depending on humidity, so that a nearly complete cross-linking occurs to prevent surface scratches. With pieces of laminated parquet, further processing can be performed, for example, by profiling of the tongue-and-groove joints. Other parts might also require further processing, or the production process ends with the coating of the surface in accordance with the invention.

With the methods in accordance with the invention, various types of parts can be produced. Besides boards for parquet floors, furniture parts or other parts made of wood-like material can also be produced in accordance with the invention. In addition to this, steel parts and parts made of nonferrous metals, plastic, paper, cardboard, papier-mâché, and mineral substances can also be coated. Other areas of application for the surface coating are also possible.

It is advantageous to once again apply heat to the surface of the reactive hot melt layer between the application and the smoothing in order to further improve the result of the smoothing. Conveniently, the smoothing occurs by means of a roller, for example, a steel roller, which can be provided with a polyurethane coating.

It is particularly advantageous if the roller is wetted with a separating agent during the smoothing. In this manner, it is effectively prevented that the as-yet-unhardened reactive hot melt layer comes off the part to be sealed and sticks to the roller. Preferably, the separating agent is applied as a solvent-free and low-viscosity substance based on paraffin wax. Such a substance, for one, prevents the reactive hot melt layer from sticking to the roller, and, moreover, the surface of the reactive hot melt surface will be considerably smoother and immediately block-free. An increase in the degree of luster of the finished sealing layer is also achievable with this separating agent. The separating agent based on paraffin wax is clear and has a thickness of ca. 0.85 g/cm$^2$ as well as a viscosity at 20° C., according to Brookfield, of ca. 34 mPas. The coating amount is ca. 20 to 35 g/m$^2$.

The separating agent is, for example, applied to the roller by a spraying procedure or a vacuum spraying procedure. However, it is preferred that the separating agent is applied to the roller by means of a saturated felting, which represents a particularly easy and secure option for obtaining an even, thin separating agent film during the smoothing of the reactive hot melt layer.

A device for producing parts with a sealing layer on their surface contains an application station, a transport device, and a smoothing station. It is a good idea to arrange a heating device between the application station and the smoothing station.

In a preferred version of the device, the smoothing station contains at least one roller, for example, a steel roller, and has a polyurethane coating. Moreover, it also advantageous if the roller can be wetted with a separating agent. This separating agent is, for example, a substance based on paraffin wax. A spray device or a saturated felting, for example, can be provided for the wetting of the roller with the separating agent.

The invention is explained in the drawing by means of a sample version. The drawing shows the following:

Figure 1:
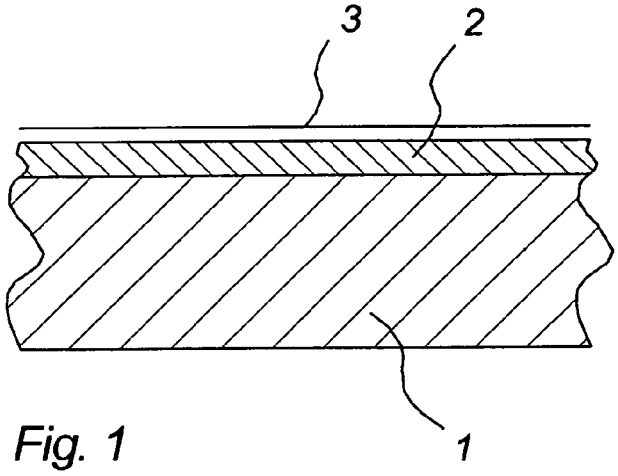
FIG. 1 shows a schematically represented section of a part in accordance with the invention with a sealing layer on the surface.

FIG. 1 shows a section of any part 1, for example, a board for a parquet floor. In the case of a board for a parquet floor, the actual board normally consists of several layers not shown in the drawing, namely at least one outer layer made of wood, which is glued with one or several sub-layers. But, it could also be a section of a piece of furniture, which can be made of solid wood or veneered parts with a wood or derived-timber product base material and adhered veneer, or wood-like products, parts made of steel, nonferrous metals, plastic, paper, cardboard, papier-mâché, or mineral substances.

There is sealing layer 2 made of a water-free and solvent-free reactive hot melt layer based on polyurethane and hardened by atmospheric humidity on the topside of part 1 that is smoothed during production by means of a roller wetted with a paraffin-based separating agent. This smoothing process creates a particularly smooth surface for the sealing layer 2, which is indicated by line 3.

Figure 2:
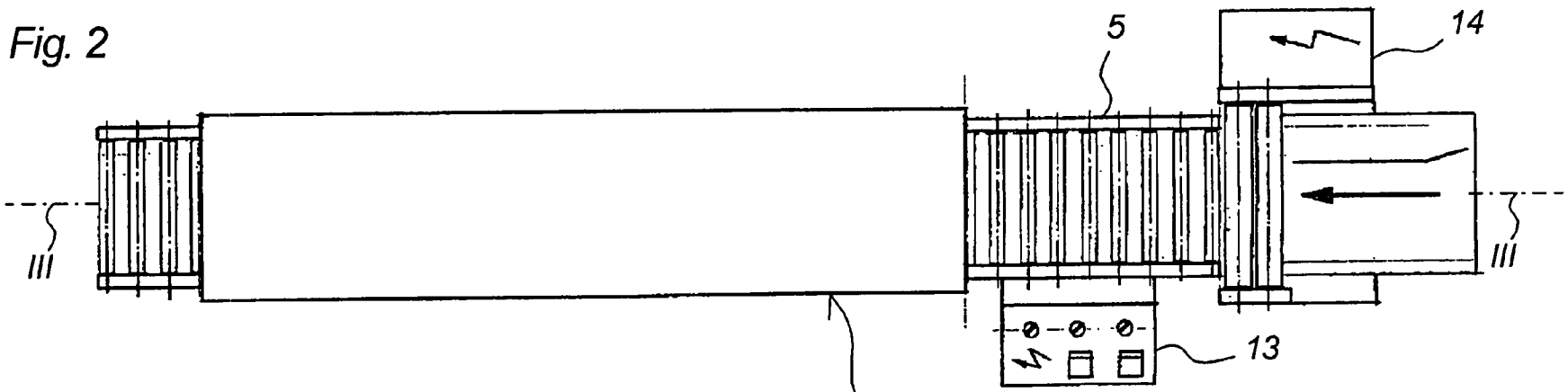
FIG. 2 shows a view of a production line for parts in accordance with the invention.
Figure 3:
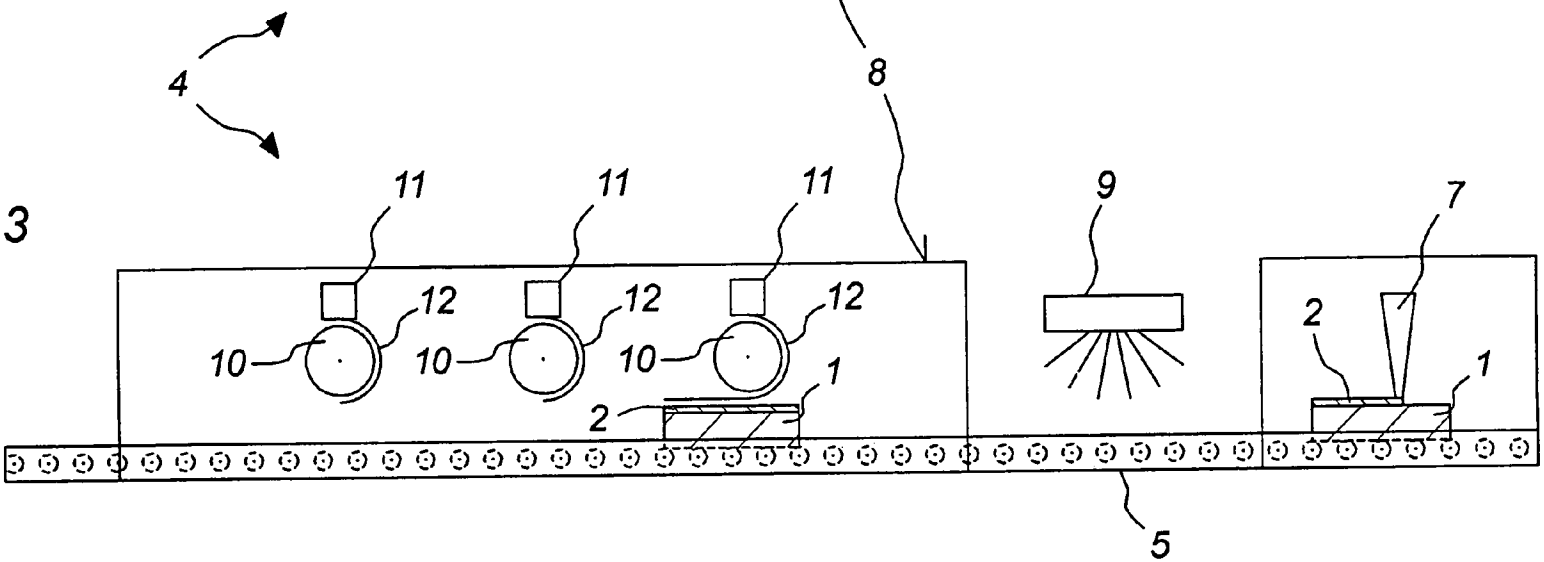
FIG. 3 shows a cut along the line III-III of FIG. 2.

FIGS. 2 and 3 show a schematically represented production line 4 for the continuous production of parts in accordance with the invention. The production line 4 contains a transport device 5 for the parts to be coated. The reactive hot melt layer is heated to at least 100° C. in application station 6 while hermetically sealed and protected from humidity; it is then pumped into a pumping device (not shown) via a heated hose, fed through the hose to an application device, for example, a fan nozzle, and applied to part 1 using the fan nozzle. The production line and its components are controlled by the indicated control unit 13. Moreover, a schematic drive unit 14 is indicated for the transport device 5.

The part 1 coated with the reactive hot melt is transported from the application station to the setting and smoothing station 8. Between the application of the reactive hot melt layer 2 and the setting station 8, heat is supplied to the surface of the reactive hot melt layer via an indicated heating device 9 in order to at least keep the reactive hot melt layer semi-fluid.

Three rollers 10 are stored in a rotatable and possibly height-adjustable manner in the setting and smoothing station 8. The rollers are, for example, provided with a polyurethane coating. Above each of the rollers 10, these are in contact with a felting 11, which is wetted with a paraffin-wax-based separating agent 12. Through the rotation of the rollers, the felting provides an even, small amount of the separating agent as a thin layer on the surface of the rollers 10, which pass this on to the reactive hot melt layer 2 during contact with the surface. The surface of the reactive hot melt layer 2 immediately becomes block-free and the smoothing procedure is supported due to the separating agent.

The coated and smoothed parts are transported on from the setting and smoothing station 8 by transport device 5 and are normally stored ca. three to five days for the cross-linking of the reactive hot melt layer 2. After complete cross-linking, the reactive hot melt layer 2 forms a sealing layer that is strongly connected with part 1, which represents a 100% solid body and whose thickness can be set, depending on requirements, between 5 and 150 my during the application. In the case of a board for a parquet floor, further processing of part 1 could occur in the profiling of the tongue-and-groove area of the board.

In conclusion, we would like to point out once again that the method in accordance with the invention is not limited to use on boards for parquet floors, but rather can be used for producing any parts with a sealing layer on the surface.

The invention claimed is:

1. A method for producing a board for a wood floor with a sealing layer on an outer topside surface, said method comprising:

providing a board for a wood floor having an outer topside surface;

applying to the surface a water-free and solvent-free reactive hot-melt sealing layer based on polyurethane in one single coat without intermediate treatment, the sealing layer having a coat strength between 5 and 150 μm, the hot-melt layer being applied to the surface at a temperature of from about 100 to 140° C.;

smoothing the hot-melt layer after application of the hot-melt layer to the surface while the hot melt layer is in a semi-fluid state; and hardening the hot-melt layer by atmospheric humidity.

2. The method of claim 1, including the step of supplying heat to the hot-melt layer between the steps of applying and smoothing the hot-melt layer.

3. The method according to claim 2, wherein the smoothing of the reactive hot-melt layer takes place by means of at least one roller.

4. The method according to claim 1, wherein the smoothing of the reactive hot-melt layer takes place by means of at least one roller.

5. The method according to claim 4, wherein a steel roller is used for smoothing.

6. The method according to claim 5, wherein the roller has a polyurethane coating.

7. The method according to claim 3, wherein the roller has a polyurethane coating.

8. The method according to claim 3, wherein the roller is wetted with a release agent during smoothing.

9. The method according to claim 4, wherein the roller is wetted with a release agent during smoothing.

10. The method according to claim 5, wherein the roller is wetted with a release agent during smoothing.

11. The method according to claim 8, wherein the release agent is applied as a solvent-free and low-viscosity agent based on paraffin wax.

12. The method according to claim 8, wherein the release agent is applied as a solvent-free and low-viscosity agent based on paraffin wax.

13. The method according to claim 8, wherein the release agent is applied to the roller in a spraying procedure.

14. The method according to claim 11, wherein the release agent is applied to the roller in a spraying procedure.

15. The method according to claim 8, wherein the release agent is applied in a vacuum spraying procedure.

16. The method according to claim 11, wherein the release agent is applied in a vacuum spraying procedure.

17. The method according to claim 8, wherein the release agent is applied to the roller by means of an impregnated felt.

18. The method according to claim 11, wherein the release agent is applied to the roller by means of an impregnated felt.

* * * * *